US006188868B1

(12) United States Patent
Shiramura

(10) Patent No.: US 6,188,868 B1
(45) Date of Patent: Feb. 13, 2001

(54) IMAGE FORMING APPARATUS

(75) Inventor: Shingo Shiramura, Kawasaki (JP)

(73) Assignee: Toshiba TEC Kabushiki Kaisha, Tokyo (JP)

( * ) Notice: Under 35 U.S.C. 154(b), the term of this patent shall be extended for 0 days.

(21) Appl. No.: 09/506,725

(22) Filed: Feb. 18, 2000

(51) Int. Cl.[7] ..... G03G 15/00
(52) U.S. Cl. ..... 399/410; 347/129; 399/82
(58) Field of Search ..... 399/82, 85, 87, 399/410, 407; 347/129, 139

(56) References Cited

U.S. PATENT DOCUMENTS 5,464,201 * 11/1995 Deen et al. ..... 399/410 X
5,913,099 * 6/1999 Kamei et al. ..... 399/410 X

* cited by examiner

*Primary Examiner*—Susan S. Y. Lee
(74) *Attorney, Agent, or Firm*—Foley & Lardner

(57) ABSTRACT

The present invention checks the paper size of input document images one by one, and cancels the stapling process when the documents have different widths in the main scanning direction. When the documents have the same width in the main scanning direction, the maximum number of the documents that can be stapled is set to be the value which is set when the documents have different sizes. Therefore, even if it is not preliminarily known whether the documents have the different sizes, the appropriate stapling operation can be executed, the received document images can be sequentially printed, and thereby the processing ability can be improved.

7 Claims, 6 Drawing Sheets

IMAGE FORMING APPARATUS

BACKGROUND OF THE INVENTION

The present invention relates to an image forming apparatus such as a complex-type digital copier for reading a document image, reproducing the image on paper, and printing image data supplied from a personal computer or the like through the LAN on paper.

Recently, a digital copier that accepts in advance the contents to be reproduced or printed out as jobs and executes the process for every unit, are practically in use.

In addition, the digital copier comprising a sorter (finisher) for providing the stapling process by a stapler are also practically in use.

When the job where sheets of paper having different sizes such as A3, A4 and the like are mixed, the operation can be executed in the only digital copier of the completion type.

The completion type indicates the operation of accepting and registering all the image data that is to be processed as the job and then start the printing.

Further, as for the number of maximum sheets of paper that can be stapled for each copy, different values are determined in accordance with the size of the paper, by the limitation of the finisher. For the same reason, the stapling process is also prohibited when the sheets of paper having different sizes are mixed.

Thus, the maximum number of sheets of paper that can be stapled is set in every size of the paper. Therefore, in a case where the number of sheets exceeds the set value, even if the execution of the stapling process is set, the process has to be canceled. In addition, in the case of the size-mixing job, the stapling process also has to be canceled.

That is, when the operation is executed in the digital copier of the completion type in which the outputting is started after inputting the image data has been finished, the number of sheets of the input document and the size-mixing job are known in advance when the inputting has been finished, i.e. before the outputting is started, as explained in FIG. 1. Thus, even if the stapling process is set when the job is started, when the operation is the size-mixing job or when the input number of sheets exceeds the maximum number of sheets that can be stapled, the printing can be executed after canceling the stapling process.

In the above-described prior art, under the control of determining whether the stapling process can be executed or not in the completion type, the received document images cannot be sequentially printed, and thus the processing capacity is made low.

However, if the received document images are sequentially printed to improve the processing capacity, it cannot be determined in advance whether the stapling process can be executed or not, in the case of the size-mixing job where the image data of different sizes is mixed, and therefore, an appropriate operation cannot be executed.

BRIEF SUMMARY OF THE INVENTION

The object of the present invention is to provide an image forming apparatus capable of allowing the stapling process to be appropriately executed and sequentially forming images from image data that the apparatus receives even when the sheets of paper having different sizes are mixed, and thereby allowing the processing performance thereof to be improved.

To achieve the above object, the present invention is an image forming apparatus comprising: receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by the receiving means. The apparatus further comprises: discrimination means for discriminating a width in the main scanning direction and a size, of each image data received by the receiving means; setting means for setting the maximum number of pages of the image data that are to be stapled, on the basis of a result of the detection of the first detecting means about the size of the first page of the image data received by the receiving means; cancellation means for canceling the setting of the stapling process when it is discriminated that the size of second and following pages of the image data received by the receiving means, as discriminated by the discrimination means, is the same as the size of the first page and that the width in the main scanning direction of the second and following pages of the image data received by the receiving means, as discriminated by the discrimination means, is different from the width in the main scanning direction of the first page; and changing means for changing the maximum number of pages that are to be stapled, as set by the setting means, when it is discriminated that the size of second and following pages of the image data received by the receiving means, as discriminated by the discrimination means, is different from the size of the first page and that the width in the main scanning direction of the second and following pages of the image data received by the receiving means, as discriminated by the discrimination means, is the same as the width in the main scanning direction of the first page.

The present invention is also an image forming apparatus comprising: receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by the receiving means. The apparatus further comprises: discrimination means for discriminating a width in the main scanning direction and a size, of each image data received by the receiving means; setting means for setting the maximum number of pages of the image data that can be stapled, on the basis of a result of the detection of the first detecting means about the size of the first page of the image data received by the receiving means; cancellation means for canceling the setting of the stapling process when it is discriminated that the size of second and following pages of the image data received by the receiving means, as discriminated by the discrimination means, is the same as the size of the first page and that the width in the main scanning direction of the second and following pages of the image data received by the receiving means, as discriminated by the discrimination means, is different from the width in the main scanning direction of the first page; first cancellation means for canceling the setting of the stapling process when it is discriminated that the size of second and following pages of the image data received by the receiving means, as discriminated by the discrimination means, is the same as the size of the first page and that the width in the main scanning direction of the second and following pages of the image data received by the receiving means, as discriminated by the discrimination means, is different from the width in the main scanning direction of the first page; second cancellation means for canceling the setting of the stapling process when the size and the width in the main scanning direction, of the second and following pages of the image data received by the receiving means, are different from the size and the width in the main scanning direction, of the first page thereof; and changing means for changing the maximum number of pages that are to be stapled, as set by the setting means, when it is discriminated that the size of second and following pages of the image data received by the receiving means, as discriminated by the discrimination means, is different from the size of the first page and that the width in the main scanning direction of the second and following pages of the image data received by the receiving means, as discriminated by the discrimination means, is the same as the width in the main scanning direction of the first page.

Further, the present invention is an image forming apparatus comprising: receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by the receiving means. The apparatus further comprises: discrimination means for discriminating a width in the main scanning direction and a size, of each image data received by the receiving means; setting means for setting the maximum number of pages of the image data that are to be stapled, on the basis of a result of the detection of the first detecting means about the size of the first page of the image data received by the receiving means; cancellation means for canceling the setting of the stapling process when it is discriminated that the size of second and following pages of the image data received by the receiving means, as discriminated by the discrimination means, is the same as the size of the first page and that the width in the main scanning direction of the second and following pages of the image data received by the receiving means, as discriminated by the discrimination means, is different from the width in the main scanning direction of the first page; changing means for changing the maximum number of pages that are to be stapled, as set by the setting means, when it is discriminated that the size of second and following pages of the image data received by the receiving means, as discriminated by the discrimination means, is different from the size of the first page and that the width in the main scanning direction of the second and following pages of the image data received by the receiving means, as discriminated by the discrimination means, is the same as the width in the main scanning direction of the first page; and execution means for executing the stapling process about plural sheets of image formation mediums on which the images are formed by the image forming means, when the number of pages of the image data received by the receiving means is smaller than the maximum number of pages of the image data that are to be stapled as changed by the changing means.

Further, the present invention is an image forming apparatus comprising: receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by the receiving means. The apparatus further comprises: discrimination means for discriminating a width in the main scanning direction and a size, of each image data received by the receiving means; setting means for setting the maximum number of pages of the image data that are to be stapled, on the basis of a result of the detection of the first detecting means about the size of the first page of the image data received by the receiving means; cancellation means for canceling the setting of the stapling process when it is discriminated that the size of second and following pages of the image data received by the receiving means, as discriminated by the discrimination means, is the same as the size of the first page and that the width in the main scanning direction of the second and following pages of the image data received by the receiving means, as discriminated by the discrimination means, is different from the width in the main scanning direction of the first page; changing means for changing the maximum number of pages that are to be stapled, as set by the setting means, when it is discriminated that the size of second and following pages of the image data received by the receiving means, as discriminated by the discrimination means, is different from the size of the first page and that the width in the main scanning direction of the second and following pages of the image data received by the receiving means, as discriminated by the discrimination means, is the same as the width in the main scanning direction of the first page; execution means for executing the stapling process about plural sheets of image formation mediums on which the images are formed by the image forming means, when the number of pages of the image data received by the receiving means is smaller than the maximum number of pages of the image data that are to be stapled as changed by the changing means; and cancellation means for canceling the setting of the stapling process when the number of pages of the image data received by the receiving means is smaller than the maximum number of pages of the image data that are to be stapled as changed by the changing means.

Moreover, the present invention is an image forming apparatus comprising: receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by the receiving mean. The apparatus further comprises: first detecting means for detecting the size of each image data received by the receiving means; second detecting means for detecting the width in the main scanning direction, of each image data received by the receiving means; setting means for setting the maximum number of pages of the image data that are to be stapled, on the basis of a result of size detecting obtained by the first detecting means, about the first page of the image data received by the receiving means; discrimination means for discriminating, when a result of the size detecting obtained by the first detecting means about the second and following pages of the image data received by the receiving means is different from the size of the first page of the image data, whether or not the width in the main scanning direction of the first page of the image data detected by the second detecting means is different from the width in the main scanning direction detected by the second detecting means about the image data having the different size; changing means for changing the maximum number of pages that are to be stapled, that has been set by the setting means, when the discrimination means discriminates that the width in the main scanning direction of the second and following pages of the image data is different from the width in the main scanning direction of the first page thereof; counting means for counting the number of the image data received by the receiving means; prohibition means for prohibiting the stapling process when the number of the image data that is counted by the counting means reaches the maximum number of pages that are to be stapled as set by the setting means or by the changing means; and execution means for executing the stapling process for the image formation medium on which images are formed by the image forming means, when receiving the image data by the receiving means has been ended and the stapling process is not prohibited by the prohibition means.

DETAILED DESCRIPTION OF THE INVENTION

An embodiment of the present invention will be explained below with reference to the drawings.

Figure 2:
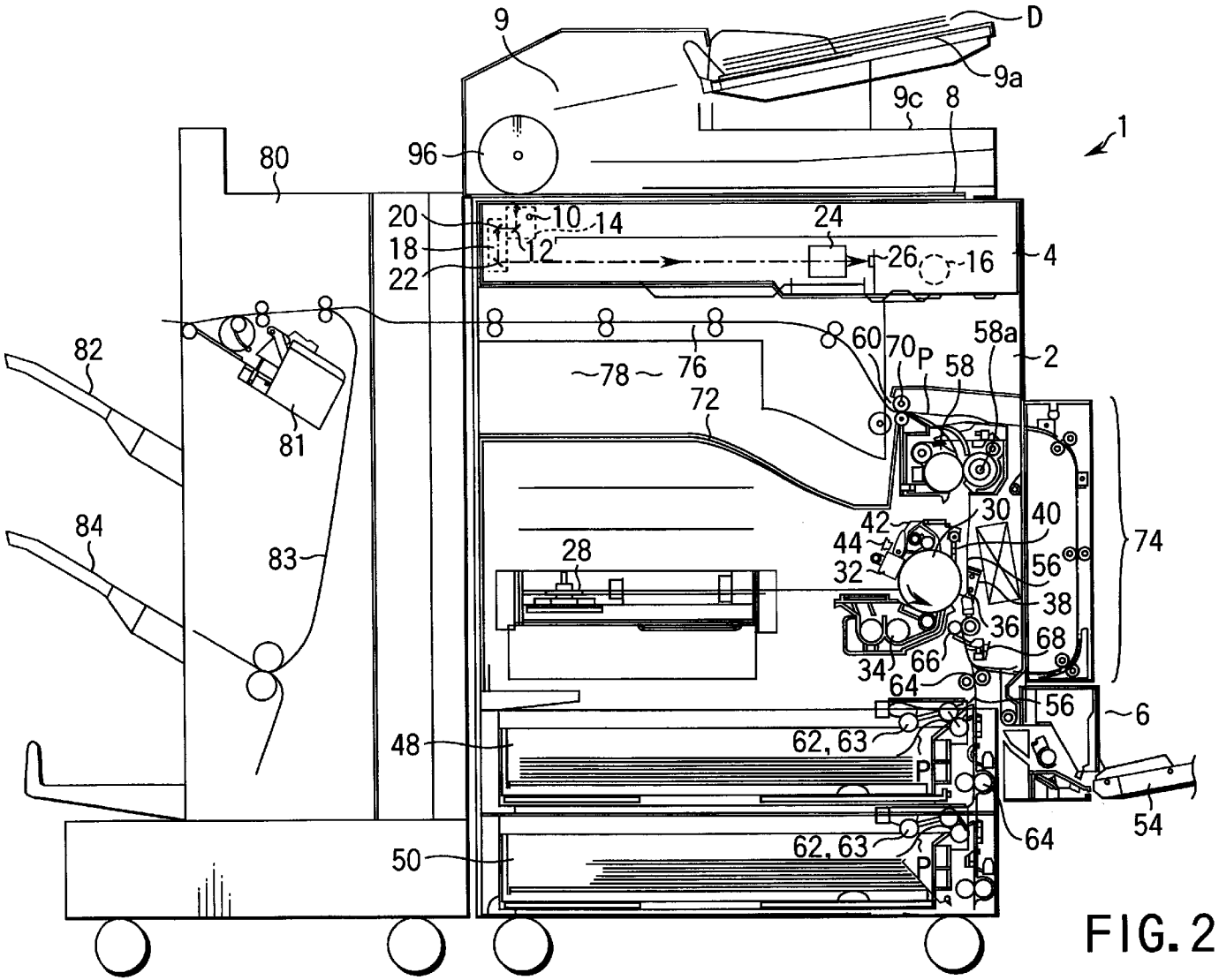
FIG. 2 is a sectional view showing a schematic structure of a digital copier according to the present invention.

FIG. 2 is a sectional view showing a schematic structure of a digital copier 1 as an example of an image forming apparatus according to the present invention.

The digital copier 1 comprises an apparatus main body 2, and a scanner section 4 serving as reading means and a printer section 6 serving as an image forming means are provided in the apparatus main body 2, as shown in FIG. 2.

A document table 8 formed of a transparent glass on which an object to be read, i.e. a document D is placed is provided on the upper surface of the apparatus main body 2. An automatic document feeder 9 (hereinafter referred to as ADF) serving as a conveyer means for automatically conveying the document D onto the document table 8 is also arranged on the upper surface of the apparatus main body 2.

The document D placed on a document tray 9*a* of the ADF 9 is conveyed by a conveyer guide (not shown) and ejected onto a ejecting tray 9*c* via a platen roller 9*b*. Thus, the document D is exposed and scanned by an exposure lamp 10 of the scanner section 4, which will be described layer, while the document D is conveyed by the platen roller 9*b*, and then the image on the document D is read.

The document D is set on the document tray 9*a* of the ADF 9, with the reading surface of the document D facing upwardly, and upper sheets of the document D are sequentially taken one by one.

The scanner section 4 provided in the apparatus main body 2 has the exposure lamp 10 constituted by a light source or, for example, a halogen lamp for illuminating the document D conveyed by the ADF 9 or the document D placed on the document table 8, and also has a first mirror 12 for deflecting a light beam reflected from the document in a predetermined direction. The exposure lamp 10 and the first mirror 12 are attached to a first carriage 14 arranged below the document table 8.

The first carriage 14 is arranged to be movable parallel to the document table 8, and reciprocates below the document table 8 via a synchronous belt (not shown) by a scanner motor (a drive motor) 16. The scanner motor 16 is constituted by a stepping motor and the like.

A second carriage 18 that can be moved parallel to the document table 8 is arranged below the document table 8. A second mirror 20 and a third mirror 22 for sequentially deflecting the reflected light from the document D that has been deflected by the first mirror 12 are attached rectangularly with one another, on the second carriage 18. The second carriage 18 receives a rotational force from the scanner motor 16 via the synchronous belt or the like that drives the first carriage 14, follows the first carriage 14, and moves parallel to first carriage 14 along the document table 8, at a half speed of that of the first carriage 14.

An image-forming lens 24 for focusing the reflected light from the third mirror 20 on the second carriage 18, and a CCD sensor (a line sensor) 26 for receiving and photoelectrically converting the reflected light focused by the image-forming lens 24, are arranged below the document table 8. The image-forming lens 24 is arranged to be movable via a drive mechanism, in a surface including an axis of the light deflected by the third mirror 22, and forms an image of the reflected light at a desired magnification (in a main scanning direction) by moving itself. CCD sensor 26 photoelectrically converts the reflected light that is made incident in accordance with an image-processing clock supplied from a CPU described later, and outputs an electric signal corresponding to the document D. The magnification in a sub-scanning direction can respond thereto by varying the carrier speed of the ADF 9 or the moving speed of the first carriage 14.

When the document D conveyed by the ADF 9 is read, the illuminating position of the exposure lamp 10 is fixed at a position shown in FIG. 2. In addition, when the document D placed on the document table 8 is read, the illuminating position of the ADF 10 is moved from the left to the right side along the document table 8.

On the other hand, the printer section 6 has a laser exposure unit 28 serving as a latent image forming means. An electrostatic latent image is formed on a peripheral surface of the photosensitive drum 30 by scanning the peripheral surface thereof with the laser light from the laser exposure unit 28.

The printer section 6 also has the rotatable photosensitive drum 30 serving as an image carrier, which is arranged at almost the center of the right side of the apparatus main body 2. The peripheral surface of the photosensitive drum 30 is exposed by the laser light from the laser exposure unit 28, and a desired electrostatic latent image is formed thereon. On the peripheral surface of the photosensitive drum 30, an electrifying charger 32 for charging the peripheral surface of the drum in a predetermined electric charge, a developing unit 34 serving as a developing means for supplying the toner as a developing agent to the electrostatic latent image formed on the peripheral surface of the photosensitive drum 30 and developing the image at a desired image concentration, a transfer charger 38 that integrally has a peeling charger 36 for separating an image-formed medium, i.e. copy paper P supplied from cassettes 48 and 50 described later from the photosensitive drum 30 and that allows the toner image formed on the photosensitive drum 30 to be transferred onto the paper P, a peeling claw 40 for peeling the copy paper P from the peripheral surface of the photosensitive drum 30, a cleaning unit 42 for cleaning the toner remaining on the peripheral surface of the photosensitive drum 30, and a deelectrifying unit 44 for deelectrifying the peripheral surface of the photosensitive drum 30, are sequentially arranged.

At the lower part in the apparatus main body 2, the upper cassette 48 and the lower cassette 50 that can be pulled from the apparatus main body are arranged in a mutually laminated state, and sheets of the copy paper P having different sizes are loaded in the cassettes 48 and 50. A manual tray 54 is provided beside the upper cassette 48.

In the apparatus main body 2, a conveyer path 56 extends from the cassettes 48 and 50 through a transfer section between the photosensitive drum 30 and the transfer charger 38, and a fixing unit 58 having a fixing lamp 58*a* is provided at the terminal end of the conveyer path. An ejection port 60 is formed above the fixing unit 58.

A paper feed roller 62 and a separating roller 63 for taking the paper P one by one from the upper cassettes 48 and the lower cassettes 50 are provided near each of the cassettes. A number of paper feed roller pairs 64 for conveying the copy paper P taken by the paper feed rollers 62 and the separating rollers 63, through the conveyer path 56, are provided in the conveyer path 56.

Resist roller pairs 66 are provided at the upstream side of the photosensitive drum 30, in the conveyer path 56. The resist roller pairs 66 correct the inclination of the copy paper P, matches the top of the toner image on the photosensitive drum 30 and the top of the copy paper P, and feeds the copy paper P to the transfer section, at the same speed as the moving speed of the peripheral surface of the photosensitive drum 30. A pre-aligning sensor 68 for detecting the arrival of the copy paper P is provided in front of the resist roller pairs 66, i.e. at the side of the paper feed rollers 64.

The copy paper P that is taken one by one from the cassettes 48 and 50 by the paper feed rollers 62 is fed to the resist roller pairs 66 by the paper feed roller pairs 64. After the top of the copy paper P is adjusted by the resist roller pairs 66, the copy paper P is fed to the transfer section.

In the transfer section, the developing agent image, i.e. the toner image formed on the photosensitive drum 30 is transferred onto the paper P by the transfer charger 38. The copy paper P on which the toner image is transferred is peeled from the peripheral surface of the photosensitive drum 30 by the functions of the peeling charger 36 and the peeling claw 40, and is conveyed to the fixing unit 58 via the conveyer belt (not shown) constituting a part of the conveyer path 56. After the developing agent image is fused onto the copy paper P by the fixing unit 58, the copy paper P is ejected through the ejection port 60 by paper ejection roller pairs 70.

An automatic double-surface feeding unit 74 for reversing the copy paper P passing through the fixing unit 58 and feeding it again to the conveyer path 56 is provided at the right side of the conveyer path 56.

A sorting lever (not shown) is provided at the ejection port 60 to sort the copy paper P ejected from the ejection port 60 onto a paper ejection tray 72 inside the apparatus main body 2 or to an external conveyor mechanism 76. The external conveyor mechanism 76 is provided at an upper hollow section 78 of the paper ejection tray 72 inside the apparatus main body 2, to convey the copy paper P ejected from the ejection port 60 outside the apparatus main body 2.

A finisher 80 is mounted on the side part of the apparatus main body 2 as an optional unit. The copy paper P (having a printing surface on the lower side) conveyed from the external conveyor mechanism 76 is supplied to the finisher 80.

The finisher 80 staples the supplied documents (paper P) at their bottom side in every copy by a stapler 81 and stores them on a tray 82. The tray 82 is vertically movable, and moves down as the documents are piled up thereon.

The copy paper P supplied to the finisher 80 is conveyed through a reverse conveyer path 83 and ejected onto a tray 84 while the printing surface faces upwardly.

An operation panel (described later) for displaying various copying conditions such as the magnification of copy and the like and making instructions such as the start of copy is provided on an upper front section of the apparatus main body 2.

Figure 1:
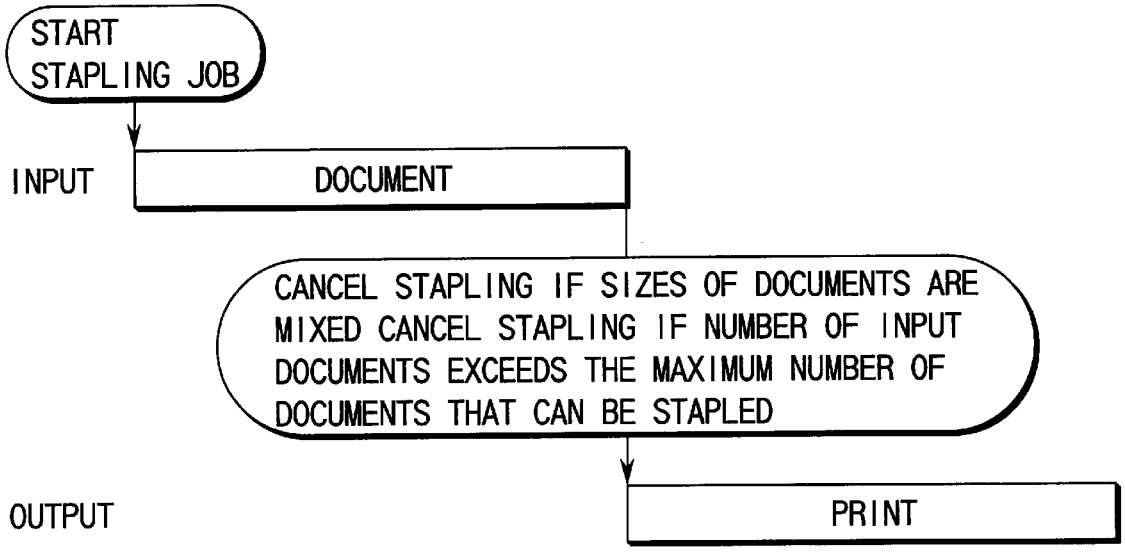
FIG. 1 is a diagram explaining a timing of reading the document as image data input, and a timing of printing on the paper as image data output, in the prior art.
Figure 3:
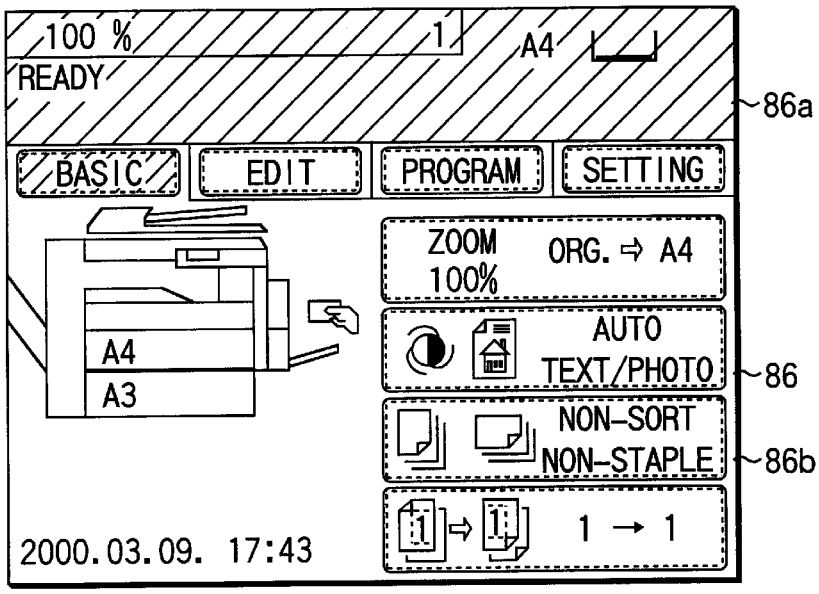
FIG. 3 is a diagram showing a display example of a liquid crystal display section.

A liquid crystal display section (LCD) 86 in which touch keys are built, for displaying the operation guidance and various instructions, as shown in FIG. 3, is provided on the operation panel.

The liquid crystal display section 86 is constituted by an operation guidance display section 86*a* for displaying the operation guidance such as "READY", and a setting display section 86*b* for changeably displaying various setting contents, as shown in FIG. 3. The setting display section 86*b* has, for example, a setting screen of basic functions as an initial screen as shown in FIG. 3. The screen displays the selecting state of the LCF 52, and the setting states indicating the zooming at 100%, the document size at A4, automatic selection of photographic images and text images, non-sorting, non-stapling, the size ratio of the document to the paper at 1 to 1. The screen also displays icons for instructions such as edit, program, changing of the setting, and the like.

The setting display section 86*b* also has setting screens of EDIT, PROGRAM and SETTINGS. For example, setting of priority, cancellation of the job, display of the job table, and the change and addition of the setting of priority can be executed on the setting screens of PROGRAM and SETTINGS.

The digital copier 1 may be used as a single body or used as a network printer.

In this case, the digital copier 1 is connected to personal computers (PC) (not shown) . . . and servers (not shown) through a local area network (LAN).

Figure 4:
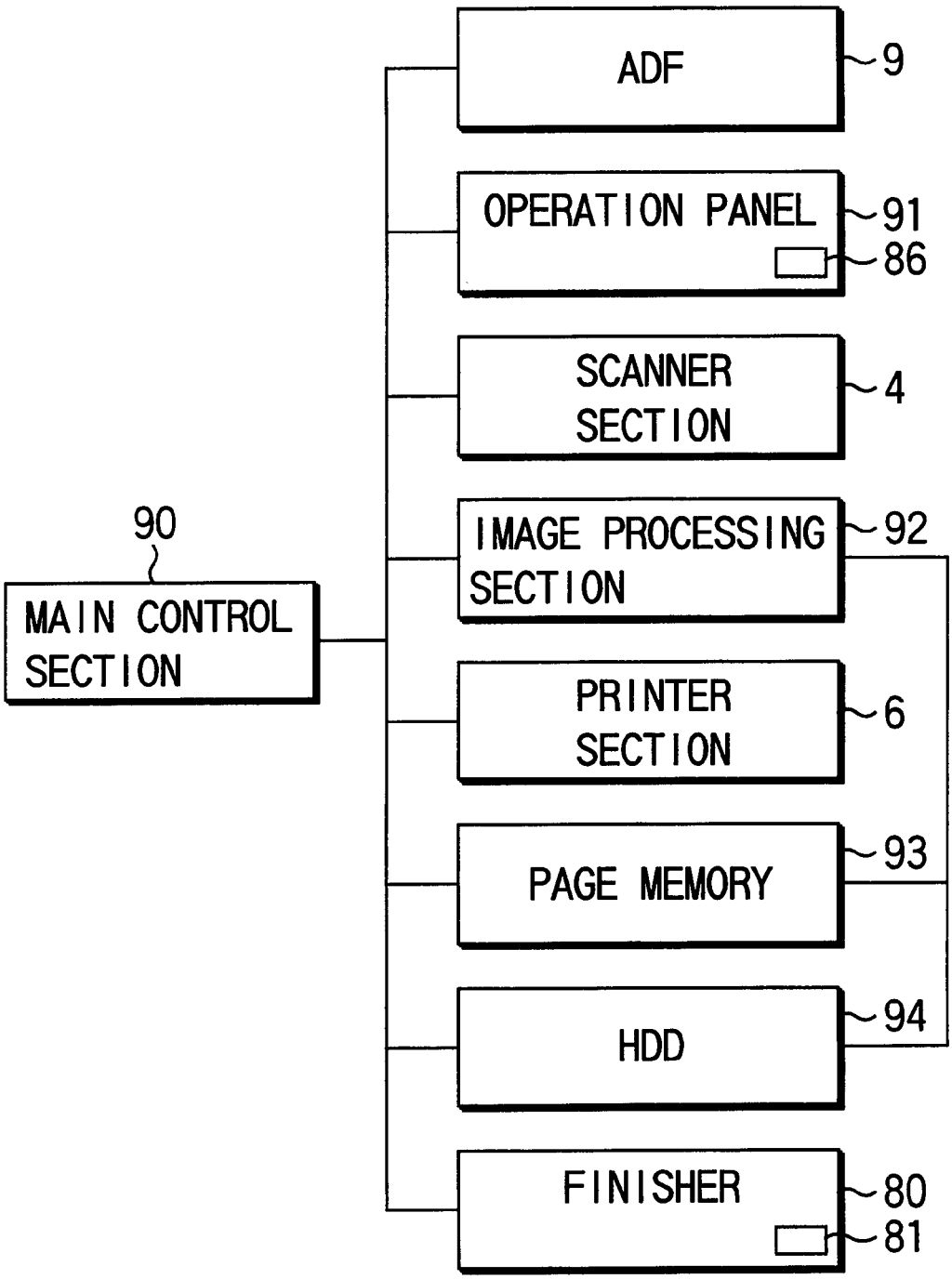
FIG. 4 is a block diagram showing an internal structure of a control circuit in the digital copier.

The inner structure of the control circuit of the digital copier 1 will be explained with referent to FIG. 4.

A main control section 90 for controlling the entire operations is provided in the digital copier 1. The main control section 90 is constituted by a CPU (central processing unit) for controlling the operation thereof, a ROM (read only memory) for storing the software for the operation of the digital copier 1, and a RAM (random access memory) (S-RAM) for temporarily storing the image data and the other operational data though they are not shown.

The main control section 90 is connected to the ADF 9, the scanner section 4, the printer section 6, the finisher 80, an operation panel 91, an image processing section 92, a page memory 93 and a HDD 94 through a bus 95. The image processing section 92, the page memory 93 and the HDD 94 are connected through an image bus 96.

The image processing section 92 processes the document images that are read by the scanner section 4, processes the image data from the page memory 93 and the HDD 94, and outputs the processed image data to the page memory 93, the printer section 6 or the HDD 94.

The image processing section 92 has a compression and decompression circuit (not shown), and compresses the image data from the page memory 93 and decompresses the image data from the HDD 94 by using the compression and decompression circuit.

The page memory 93 registers the image data from the image processing section 92.

The HDD 94 is an external memory unit as represented by a hard disk for storing various data. In copying a plurality of copies of the documents, for example, the HDD 94 registers images obtained by compressing a plurality of document images, and reads and prints the compressed images at the time of the printing.

The maximum number of documents to be stapled is preliminarily registered for every document size, in the HDD 94. The maximum number of documents stapled when the documents of different sizes that have the same width in the main scanning direction are mixed, is also preliminarily registered therein.

The main control section 91 has an input task and a printing task that are managed for every job.

Figure 5:
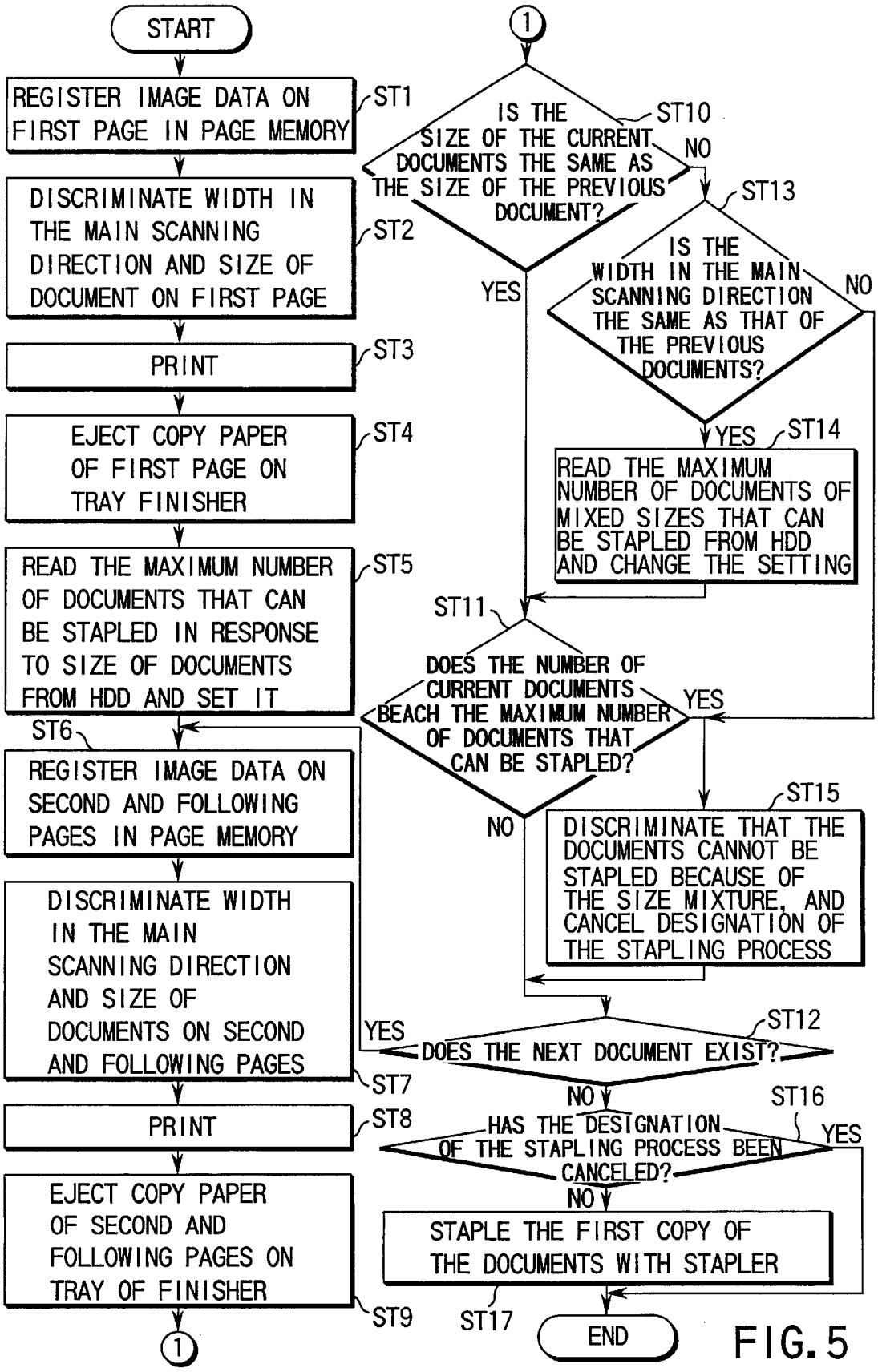
FIG. 5 is a flow chart explaining the printing process.

Next, the process of sequentially reading and printing a plurality of documents D placed on the tray 9*a* of the ADF 9, in the above-described structure, will be explained with reference to a flow chart shown in FIG. 5.

A first document D is conveyed by the ADF 9, the image data is read in every scanning line of the main scanning direction by the CCD sensor 26 of the scanning section 4, subjected to the mirror-image conversion, and registered in the page memory 93 (ST1). The main control section 90 discriminates the width of the document D in the main scanning direction and the size of the document D in accordance with the image data registered in the page memory 93(ST2).

After the image for one page of the document has been registered in the page memory 93, it is rotated at 180 degrees and registered again in the page memory 93. This registered image is compressed and registered in the HDD 94. The image data of the rotated image for every scanning line of the main scanning direction is sequentially read from the page memory 93, an electrostatic latent image (an exposed image) is formed on the photosensitive drum 30 by the laser light from the laser exposure unit 28, and this electrostatic latent image is developed (i.e. converted into a visible image) by the developing unit 34. The paper P having the same size as that of the document D is fed from the cassette and conveyed in front of the transfer section. Thus, the copy paper P is conveyed at the same timing as the developed image on the photosensitive drum 30, and the image data of the document D is transferred to the copy paper P having the same size in the transfer section. After that, the image data is fixed by the fixing unit 58 and the printing is executed (ST3). After ejected from the ejection port 60, the copy paper P is conveyed to the finisher 80 via the external conveyor mechanism 76. Therefore, the copy paper P is ejected onto the tray 82 while its printed surface faces downwardly (ST4).

The main control section 90 reads the maximum number of sheets that can be stapled in response to the size of the first document D, from the HDD 94, and sets the number (ST5).

Next, a second document D is conveyed by the ADF 9, the image data is read in every scanning line of the main scanning direction by the CCD sensor 26 of the scanning section 4, subjected to the mirror-image conversion, and registered in the page memory 93 (ST6). The main control section 90 discriminates the width of the document D in the main scanning direction and the size of the document D in accordance with the image data registered in the page memory 93(ST7).

After the image for one page of the document has been registered in the page memory 93, it is rotated at 180 degrees and registered again in the page memory 93. This registered image is compressed and registered in the HDD 94. The image data of the rotated image for every scanning line of the main scanning direction is sequentially read from the page memory 93, an electrostatic latent image (an exposed image) is formed on the photosensitive drum 30 by the laser light from the laser exposure unit 28, and this electrostatic latent image is developed (i.e. converted into a visible image) by the developing unit 34. The paper P having the same size as that of the document D is fed from the cassette and conveyed in front of the transfer section. Thus, the copy paper P is conveyed at the same timing as the developed image on the photosensitive drum 30, and the image data of the document D is transferred to the copy paper P having the same size in the transfer section. After that, the image data is fixed by the fixing unit 58 and the printing is executed (ST8). After ejected from the ejection port 60, the copy paper P is conveyed to the finisher 80 via the external conveyor mechanism 76. Therefore, the copy paper P is ejected onto the tray 82 while its printed surface faces downwardly (ST9).

The main control section 90 discriminates whether the size of the current (second) document D is the same as the size of the previous (first) document D or not (ST10). If the main control section 90 discriminates that the documents have the same size, it discriminates whether the number of the current documents reaches the maximum number of the documents that can be stapled or not (ST11). If the number of the current documents D does not reach the maximum number of the documents that can be stapled, as a result of this discrimination, the main control section 90 discriminates whether a following document D exists or not (ST12). If a following document D exists, the operation returns to step 6 and proceeds to the reading process of the following document D.

If the main control section 90 discriminates that the documents are not in the same size at step 10, it discriminates whether the width of the current document is the same as the width of the previous document, in the main scanning direction, or not (ST13). If the main control section 90 discriminates that the documents have the same width in the main scanning direction, it discriminates the mixture of the documents, reads the maximum number of the documents that can be stapled, in accordance with the mixture, from the HDD 94, and changes the setting (ST14). The operation proceeds to step 11.

If the main control section 90 discriminates that the documents does not have the same width in the main scanning direction at step 13, and if the number of the current documents D does not reach the maximum number of the documents that can be stapled, as a result of the discrimination at step 11, the main control section 90 discriminates the mixture of the documents that cannot be stapled and cancels the designation of the stapling process (ST15), and the operation proceeds to step 12.

If the following document D does not exist as a result of the discrimination at step 12, the main control section 90 confirms whether the designation of the stapling process is canceled or not (ST16). If the designation of the stapling process is canceled, the process for the first copy is ended, and if the designation of the stapling process is not canceled, the stapling process for the first copy is executed by the stapler 81 (ST17).

After that, when the printing process for the second copy is executed, the image data is sequentially read from the HDD 94 and decompressed, and therefore, the printing process is executed in the same manner as described above.

Next, a specific example will be explained.

In this case, the maximum number of A4-size documents that can be stapled is set at fifty, the maximum number of A3-size documents that can be stapled is set at thirty, and the maximum number of documents of mixed A4 and A3 sizes that can be stapled is set at twenty five.

First, a case where a first document is subjected to the process for the documents of the other size will be explained with reference to FIG. 6.

That is, an A4-size document is read as a first document, and the maximum number of documents that can be stapled is set at fifty. Then, after reading (input) of the A4-size documents and printing (output) thereof on the paper are repeated, reading (input) of the A3-size documents and printing (output) thereof on the paper are repeated.

Figure 6:
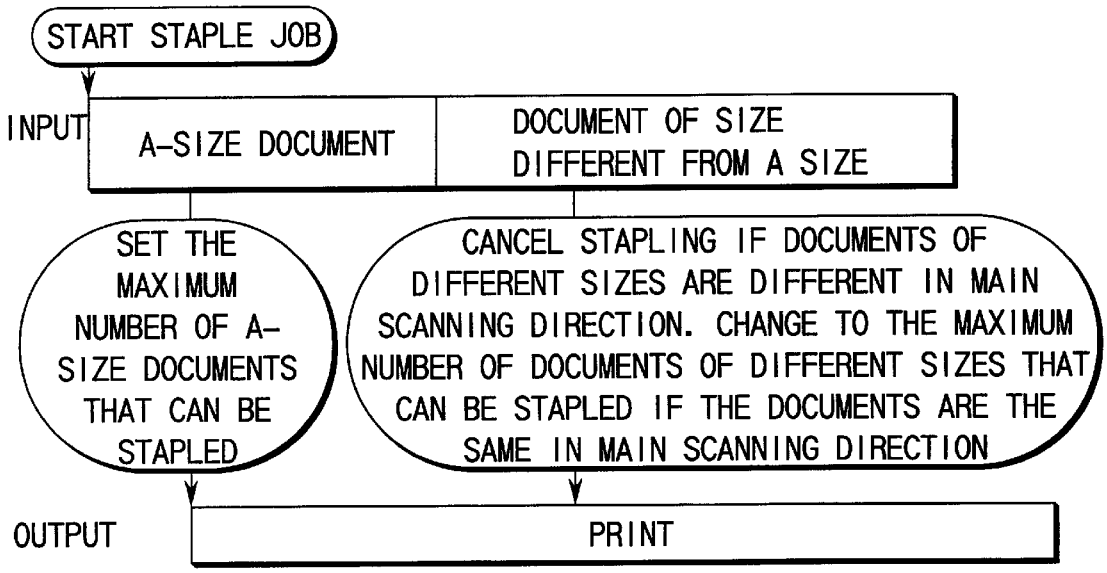
FIGS. 6 to 11 are diagrams explaining the variation in the maximum number of sheets that can be stapled in response to the size of the paper, and cancellation of the stapling process, in the present invention.

When the twentieth A4-size document has been read and an A3-size document is read as the twenty-first document, if the documents have the different widths in the main scanning direction, designation of the stapling process is canceled because of the mixed size of the documents having the different widths in the main scanning direction, as shown in, for example, FIG. 6. Thus, when the printing is ended, the stapling process is not executed.

Further, when the twentieth A4-size document has been read and the A3-size document is read as the twenty-first document, if the documents have the same width in the main scanning direction, the maximum number of documents that can be stapled is set at twenty five.

Next, a case where a first document is subjected to the process for the documents of the other sizes that have the different widths in the main scanning direction will be explained with reference to FIG. 7.

That is, an A4-size document is read as a first document, and the maximum number of documents that can be stapled is set at fifty. Then, after reading (input) of the A4-size documents and printing (output) thereof on the paper are repeated, reading (input) of the B4-size documents and printing (output) thereof on the paper are repeated.

Figure 7:
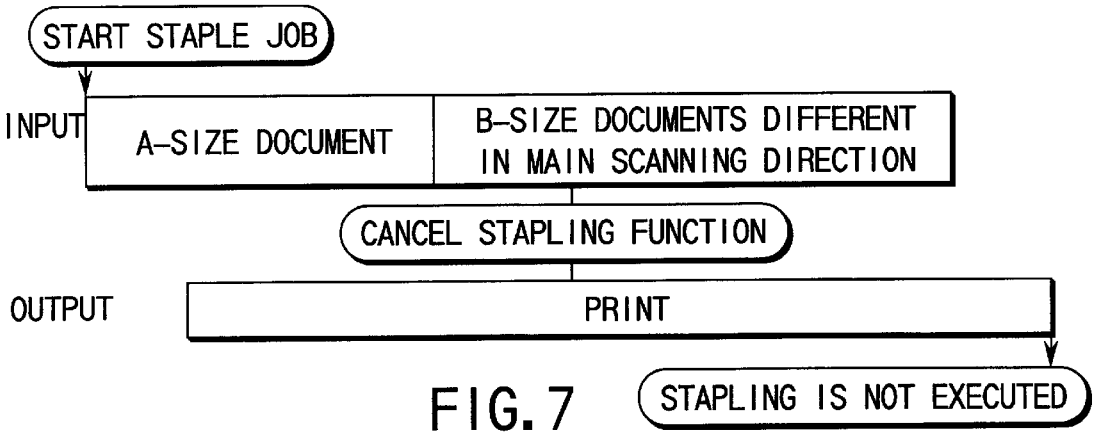

When the B4-size documents are read, designation of the stapling process is canceled, as shown in, for example, FIG. 7. Thus, when the printing is ended, the stapling process is not executed.

Next, a case where a first document is subjected to the process for the documents of the other size that have the same width in the main scanning direction will be explained with reference to FIGS. 8, 9 and 10.

That is, an A4-size document is read as a first document, and the maximum number of documents that can be stapled is set at fifty. Then, after reading (input) of the A4-size documents and printing (output) thereof on the paper are repeated, reading (input) of the A3-size documents and printing (output) thereof on the paper are repeated.

Figure 8:
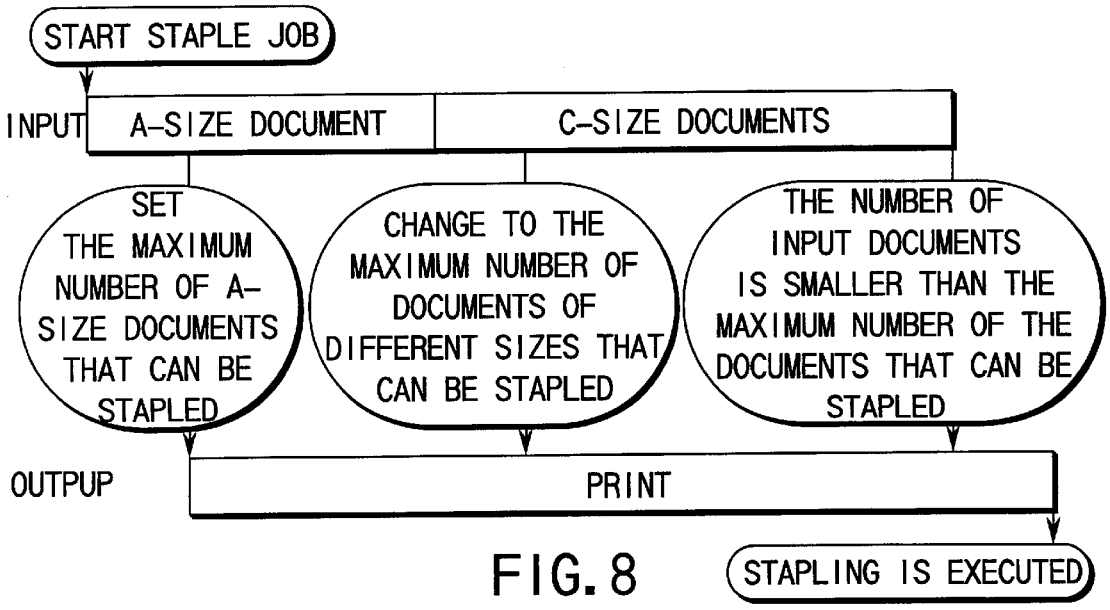

When the twentieth A4-size document has been read and the A3-size document is read as the twenty-first document, if the documents have the same width in the main scanning direction, the maximum number of documents that can be stapled is set at twenty five, as shown in, for example, FIG. 8. After that, when the printing of not more than twenty-five documents has been ended, the stapling process is executed.

Figure 9:
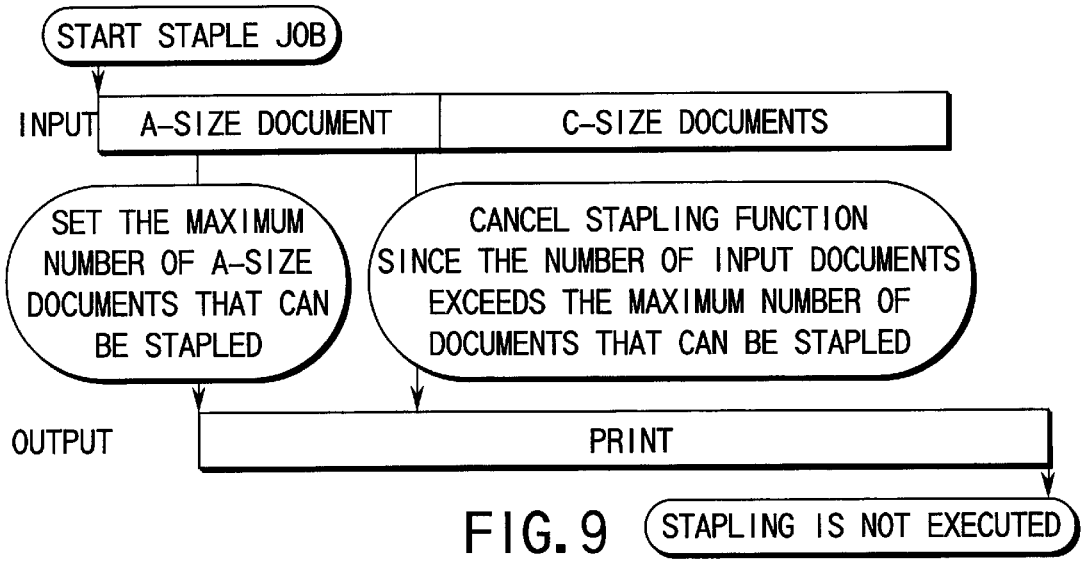

When the fifty-first A4-size document is read, designation of the stapling process is canceled as shown in, for example, FIG. 9, since the number of the documents exceeds the maximum number of the documents that can be exceeded. Thus, when the printing is ended, the stapling process is not executed.

Figure 10:
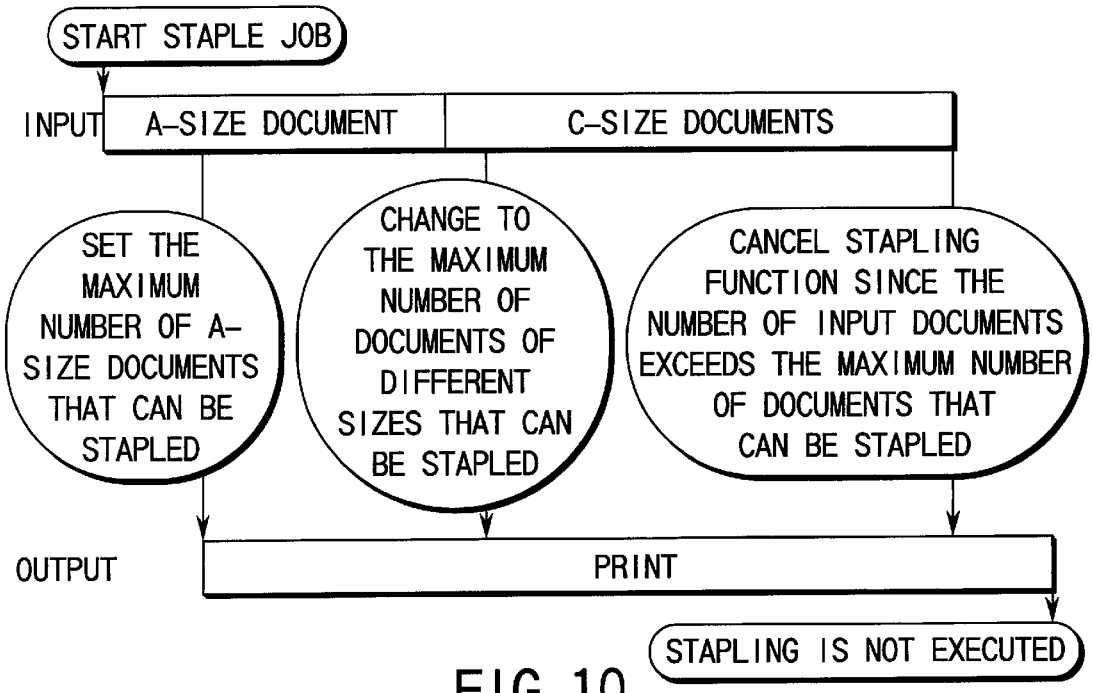

When the twenty-fourth A4-size document has been read and the A3-size document is read as the twenty-fifth document, the maximum number of documents that can be stapled is set at twenty five, as shown in, for example, FIG. 10. After that, when the twenty-sixth A3-size document has been read, designation of the stapling process is canceled since the number of the documents exceeds the maximum number of the documents that can be exceeded. Thus, when the printing is ended, the stapling process is not executed.

Next, a case where the documents of a single size are processed at the number that is not more than the maximum number of the documents that can be stapled, will be explained with reference to FIG. 11.

That is, the A4-size document is read as the first document, and the maximum number of the documents that can be stapled is set at fifty. After that, reading (input) of the A4-size documents and printing (output) thereof on the paper are repeated.

Figure 11:
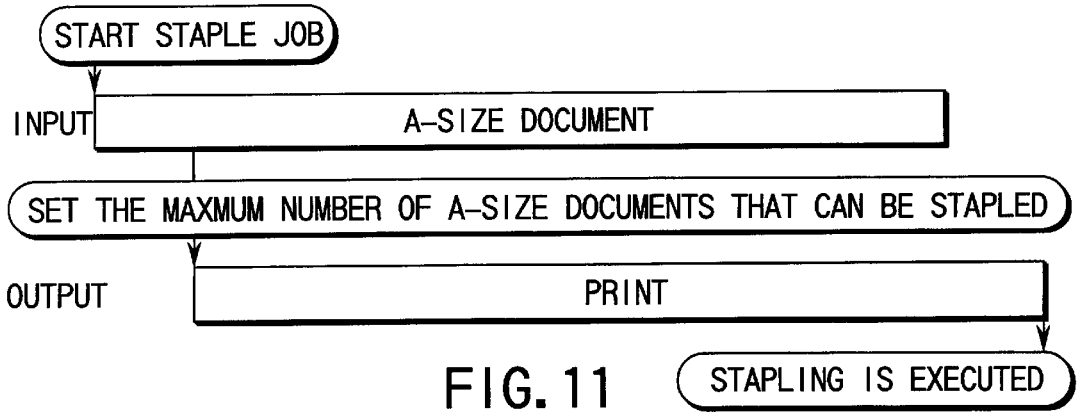

In this case, the stapling process is executed after the printing has been ended as shown in FIG. 11, since the number of the documents is not more than fifty.

As described, even if it is not preliminarily known whether the documents have the different sizes, the appropriate stapling operation can be made by changing the setting while the job is executed, and the received document images can be sequentially printed.

That is, the paper size of each input document image is checked, and the stapling process is canceled at the job in which the documents have the different widths in the main scanning direction.

In the case of the job in which the documents have the same width in the main scanning direction, the maximum number of documents that can be stapled is set at the value in the case where the documents have the different sizes.

Therefore, even if it is not preliminarily known whether the documents have the different sizes, the appropriate stapling operation can be executed, the received document images can be sequentially printed, and thereby the processing ability can be improved.

In the above-described example, the document size and the width in the main scanning direction are discriminated from the image data of the page memory. However, they may be discriminated from the output of a detecting unit or the CCD sensor.

What is claimed is:

1. An image forming apparatus comprising:

receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by said receiving means, said apparatus further comprising:

discrimination means for discriminating a width in the main scanning direction and a size, of each image data received by said receiving means;

setting means for setting the maximum number of pages of the image data that are to be stapled, on the basis of a result of the detection of a first detecting means about the size of the first page of the image data received by said receiving means;

cancellation means for canceling the setting of the stapling process when it is discriminated that the size of second and following pages of the image data received by said receiving means, as discriminated by said discrimination means, is the same as the size of the first page and that the width in the main scanning direction of the second and following pages of the image data received by said receiving means, as discriminated by said discrimination means, is different from the width in the main scanning direction of the first page; and changing means for changing the maximum number of pages that are to be stapled, as set by said setting means, when it is discriminated that the size of second and following pages of the image data received by said receiving means, as discriminated by said discrimination means, is different from the size of the first page and that the width in the main scanning direction of the second and following pages of the image data received by said receiving means, as discriminated by said discrimination means, is the same as the width in the main scanning direction of the first page.

2. An image forming apparatus comprising:

receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by said receiving means, said apparatus further comprising:

discrimination means for discriminating a width in the main scanning direction and a size, of each image data received by said receiving means;

setting means for setting the maximum number of pages of the image data that can be stapled, on the basis of a result of the detection of a first detecting means about the size of the first page of the image data received by said receiving means;

cancellation means for canceling the setting of the stapling process when it is discriminated that the size of second and following pages of the image data received by said receiving means, as discriminated by said discrimination means, is the same as the size of the first page and that the width in the main scanning direction of the second and following pages of the image data received by said receiving means, as discriminated by said discrimination means, is different from the width in the main scanning direction of the first page;

first cancellation means for canceling the setting of the stapling process when it is discriminated that the size of second and following pages of the image data received by said receiving means, as discriminated by said discrimination means, is the same as the size of the first page and that the width in the main scanning direction of the second and following pages of the image data received by said receiving means, as discriminated by said discrimination means, is different from the width in the main scanning direction of the first page;

second cancellation means for canceling the setting of the stapling process when the size and the width in the main scanning direction, of the second and following pages of the image data received by said receiving means, are different from the size and the width in the main scanning direction, of the first page thereof; and changing means for changing the maximum number of pages that are to be stapled, as set by said setting means, when it is discriminated that the size of second and following pages of the image data received by said receiving means, as discriminated by said discrimination means, is different from the size of the first page and that the width in the main scanning direction of the second and following pages of the image data received by said receiving means, as discriminated by said discrimination means, is the same as the width in the main scanning direction of the first page.

3. An image forming apparatus comprising:

receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by said receiving means, said apparatus further comprising:

discrimination means for discriminating a width in the main scanning direction and a size, of each image data received by said receiving means;

setting means for setting the maximum number of pages of the image data that are to be stapled, on the basis of a result of the detection of a first detecting means about the size of the first page of the image data received by said receiving means;

cancellation means for canceling the setting of the stapling process when it is discriminated that the size of second and following pages of the image data received by said receiving means, as discriminated by said discrimination means, is the same as the size of the first page and that the width in the main scanning direction of the second and following pages of the image data received by said receiving means, as discriminated by said discrimination means, is different from the width in the main scanning direction of the first page;

changing means for changing the maximum number of pages that are to be stapled, as set by said setting means, when it is discriminated that the size of second and following pages of the image data received by said receiving means, as discriminated by said discrimination means, is different from the size of the first page and that the width in the main scanning direction of the second and following pages of the image data received by said receiving means, as discriminated by said discrimination means, is the same as the width in the main scanning direction of the first page; and execution means for executing the stapling process about plural sheets of image formation mediums on which the images are formed by said image forming means, when the number of pages of the image data received by said receiving means is smaller than the maximum number of pages of the image data that are to be stapled as changed by said changing means.

4. An image forming apparatus comprising:

receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by said receiving means, said apparatus further comprising:

discrimination means for discriminating a width in the main scanning direction and a size, of each image data received by said receiving means;

setting means for setting the maximum number of pages of the image data that are to be stapled, on the basis of a result of the detection of a first detecting means about the size of the first page of the image data received by said receiving means;

cancellation means for canceling the setting of the stapling process when it is discriminated that the size of second and following pages of the image data received by said receiving means, as discriminated by said discrimination means, is the same as the size of the first page and that the width in the main scanning direction of the second and following pages of the image data received by said receiving means, as discriminated by said discrimination means, is different from the width in the main scanning direction of the first page;

changing means for changing the maximum number of pages that are to be stapled, as set by said setting means, when it is discriminated that the size of second and following pages of the image data received by said receiving means, as discriminated by said discrimination means, is different from the size of the first page and that the width in the main scanning direction of the second and following pages of the image data received by said receiving means, as discriminated by said discrimination means, is the same as the width in the main scanning direction of the first page;

execution means for executing the stapling process about plural sheets of image formation mediums on which the images are formed by said image forming means, when the number of pages of the image data received by said receiving means is smaller than the maximum number of pages of the image data that are to be stapled as changed by said changing means; and cancellation means for canceling the setting of the stapling process when the number of pages of the image data received by said receiving means is smaller than the maximum number of pages of the image data that are to be stapled as changed by said changing means.

5. An apparatus according to claim 1, characterized in that said receiving means comprises conveyer means for conveying a document, and reading means for reading the document conveyed by said conveyer means by use of a line sensor.

6. An apparatus according to claim 1, characterized in that said receiving means receives the image data supplied from an external unit via a communication line.

7. An image forming apparatus comprising:

receiving means for sequentially receiving a plurality of pages of image data of at least, a single size, in a main scanning direction and in a sub-scanning direction, in accordance with an instruction of a stapling process; and image forming means for sequentially forming images on an image formation medium, on the basis of each page of the image data received by said receiving means, said apparatus further comprising:

first detecting means for detecting the size of each image data received by said receiving means;

second detecting means for detecting the width in the main scanning direction, of each image data received by said receiving means;

setting means for setting the maximum number of pages of the image data that are to be stapled, on the basis of a result of size detecting obtained by said first detecting means, about the first page of the image data received by said receiving means;

discrimination means for discriminating, when a result of the size detecting obtained by said first detecting means about the second and following pages of the image data received by said receiving means is different from the size of the first page of the image data, whether or not the width in the main scanning direction of the first page of the image data detected by said second detecting means is different from the width in the main scanning direction detected by said second detecting means about the image data having the different size;

changing means for changing the maximum number of pages that are to be stapled, that has been set by said setting means, when said discrimination means discriminates that the width in the main scanning direction of the second and following pages of the image data is different from the width in the main scanning direction of the first page thereof;

counting means for counting the number of the image data received by said receiving means;

prohibition means for prohibiting the stapling process when the number of the image data that is counted by said counting means reaches the maximum number of pages that are to be stapled as set by said setting means or by said changing means; and execution means for executing the stapling process for the image formation medium on which images are formed by said image forming means, when receiving the image data by said receiving means has been ended and the stapling process is not prohibited by said prohibition means.

* * * * *